United States Patent [19]

Fisher et al.

[11] Patent Number: 4,458,577

[45] Date of Patent: Jul. 10, 1984

[54] ACCELERATION APPARATUS WITH ANNULAR PROJECTILE ACCELERATED THEREBY

[75] Inventors: George P. Fisher, Santa Monica; Albert L. Latter, Marina del Rey, both of Calif.

[73] Assignee: R & D Associates, Marina del Rey, Calif.

[21] Appl. No.: 942,943

[22] Filed: Sep. 18, 1978

[51] Int. Cl.[3] ..... F41F 1/02

[52] U.S. Cl. ..... 89/8; 124/3

[58] Field of Search ..... 124/1, 3; 89/1 R, 8; 310/10, 14, 178; 322/2 A, 48; 318/253, 473

[56] References Cited

U.S. PATENT DOCUMENTS

| | | | |
|---|---|---|---|
| 2,870,675 | 1/1959 | Salisbury | 89/1 R |
| 3,126,789 | 3/1964 | Meyer | 89/8 |
| 3,273,553 | 9/1966 | Doyle | 124/3 |
| 3,431,816 | 3/1969 | Dale | 89/8 |
| 4,086,506 | 4/1978 | Kustom et al. | 310/74 |

FOREIGN PATENT DOCUMENTS

| | | | |
|---|---|---|---|
| 2250803 | 4/1974 | Fed. Rep. of Germany | 124/3 |
| 2636 | of 1915 | United Kingdom | 124/3 |

OTHER PUBLICATIONS

"Performance of Coaxial Plasma Gun with Various Propellants", Charles J. Michels et al., *The Physics of Fluids*, vol. 7, No. 11, (Part 2 of Two Parts), American Institute of Physics, New York, N.Y., Nov. 1964.

"The Acceleration of Macroparticles and a Hypervelocity Electromagnetic Accelerator", J. P. Barber, The Australian National University, Mar. 1972.

K. W. Miller et al., "Study of Electromagnetic Gun", *Proceedings of the Second Hypervelocity and Impact Effects Symposium*, vol I, Dec. 1957, pp. 132–134, Sponsored by U.S. Naval Research Laboratory and the Air Research and Development Command.

*Primary Examiner*—Richard T. Stouffer

*Attorney, Agent, or Firm*—Poms, Smith, Lande & Rose

[57] ABSTRACT

A high power source of electrical energy, such as a homopolar generator, is connected to a longitudinally extending coaxial structure which forms a gun barrel. Within the gun barrel toward the end to which the power supply is connected is mounted a coaxial projectile, or several projectiles, in engagement with one or more movable conductive elements, that extend between the two longitudinally extending conductors. The homopolar generator is switched to apply on the order of a megajoule of energy to the coaxial structure, and after being delayed for a short interval until the current has built up to a significant level, the conductive element is accelerated with the projectile as a result of the magnetic pressure building up within the coaxial structure. Velocities on the order of 2 kilometers per second with kilogram mass projectiles may be achieved with a gun barrel approximately one meter in length.

23 Claims, 12 Drawing Figures

ACCELERATION APPARATUS WITH ANNULAR PROJECTILE ACCELERATED THEREBY

FIELD OF THE INVENTION

This invention relates to a magnetic gun, or more generally to arrangements for accelerating objects to high speed as a result of magnetic pressures induced by large electrical currents.

BACKGROUND OF THE INVENTION

Conventional guns operated by conventional explosives are capable of accelerating objects to a speed of a couple kilometers per second, which is approximately the speed of sound in chemical explosive material. Various proposals have been set forth to provide higher velocity projectiles and some of these are disclosed in W. W. Salisbury, U.S. Pat. No. 2,870,675, granted Jan. 27, 1959, and entitled, "Acceleration Amplifier". In the above patent, Mr. Salisbury discloses an ingenious and somewhat elaborate arrangement for transferring energy from a large conventional projectile moving relatively slowly to a lighter weight projectile made of magnetic material to be accelerated to a higher velocity—hopefully improving on speeds attainable with conventional guns. In addition, in the introduction of the Salisbury patent various other proposed arrangements are described, including an alleged German gun which was stated to be "a moving short circuit between a pair of parallel rails and to have been accelerated to a velocity of 2 kilometers per second". The Salisbury patent notes certain problems relative to the alleged German design. It appears that such a gun would be highly inefficient in view of the dispersion of the magnetic field and other problems of the structure.

Accordingly, a principal object of the present invention is to increase the efficiency and effectiveness of unconventional guns such as those noted above.

SUMMARY OF THE INVENTION

In accordance with a specific illustrative embodiment of the invention, a high power, low-impedance pulse source, such as a homopolar generator, is connected to a coaxial structure which forms part of a gun barrel. A projectile is located within the gun barrel, and a conductor or conductive material, in engagement with the projectile, extends across between the coaxial conductors forming part of the gun barrel at the end where it is connected to the homopolar generator. Switching circuitry applies a high power pulse to the coaxial structure, and arrangements are provided for initially delaying movement of the conductor bridging the coaxial line within the gun barrel. After the current from the homopolar generator has built up to a significant level, the conductor is released, and the magnetic pressure within the coaxial structure rapidly accelerates the movable conductor and the associated projectile or projectiles, and they are expelled at high velocity from the gun barrel. Velocities of 2 kilometers per second and higher may be achieved with a suitably powerful pulse applied to the coaxial conductor structure.

In accordance with a feature of the invention, the gun barrel may be reinforced externally with steel or other high strength material.

In accordance with another aspect of the invention, the coaxial structure may be energized from any powerful source capable of supplying at least a half a megajoule electrical impulse to the coaxial structure in a small fraction of a second.

Concerning arrangements for delaying the initial movement of the movable conductive material in the gun barrel, this may be accomplished either mechanically, electrically, or through suitable switching arrangements. More specirically, mechanical detents which yield at a predetermined pressure can delay the initial movement of the conductive element; a thin shunting conductor, in the order of 1 millimeter thick, will have rapidly increasing resistance with temperature so that current will be transferred from it to the movable conducting element as the current builds up. Mechanical switches could also be used, with their actuation timed to follow the closing of the brushes in the homopolar generator by a predetermined time interval. Meltable material may also be employed between the movable conductive material in the gun barrel and the walls of the gun, so that initial restraint is achieved. This meltable material could be lead, for example, or solder. Also, the movable foil disclosed in our copending U.S. patent application, Ser. No. 818,349 filed July 25, 1977 could be employed. In cases where a shunting element is employed, it is desirable that it be held in the open state following shifting of the current to the movable conductive element, and this may be accomplished through the use of a bi-metallic element or through any other desired technique. Mechanical or pneumatic elements may also be employed for shifting the position of the switch from the short-circuiting position to one in which the current must flow through the movable conductive element.

If the gun barrel is coaxial throughout its length, then, using a single unitary projectile, it must include a hole through its center. As an alternative to such a structure, it is contemplated that two or more solid projectiles could be employed spaced around the center conductor between the inner and outer conductors of the coaxial structure included in the gun barrels. Alternatively, a solid projectile could be spaced ahead of the coaxial structure and from the movable conducting element bridging between the central conductor and the outer conductor forming the inside of the gun barrel; however, with such an arrangement, a longer gun barrel would be required. Also, the movable conductor could be provided with a movable central portion extending back beyond the input end of the gun barrel, to maintain the electrical continuity in the coaxial structure as the projectile and movable conductor move forward.

In summary, several of the important aspects of the present system involve (1) the use of a low impedance, high power source such as a homopolar generator; (2) the use of a high current switch or other arrangements for preventing the magnetic pressure from accelerating before the current reaches a significant level; (3) the use of a coaxial type conductor structure to confine the magnetic field and utilizes the magnetic pressure efficiently to accelerate the projectile; and (4) the fact that the projectile need not be of magnetic material, such as iron.

One of the principal advantages of the present invention is that the speed of velocity of the projectile is not limited to the velocity of sound through an explosive, but only by the available magnitude of the current pulse to be applied to the coaxial electrical structure, and to the mechanical strength of the gun barrel and related equipments.

Other objects, features, and advantages of the present invention will become apparent from a consideration of the following detailed description, and from the accompanying drawings.

DETAILED DESCRIPTION

Figure 1:
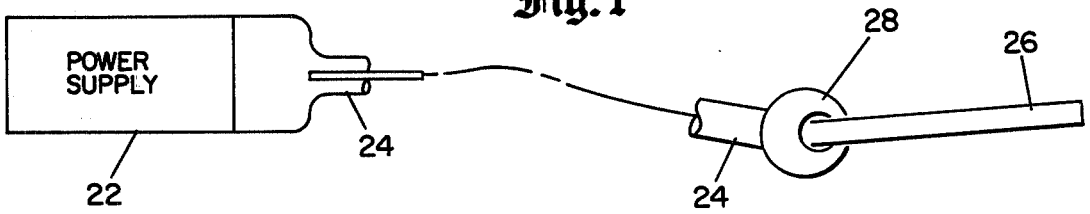
FIG. 1 is a block diagram of a magnetic gun illustrating the principles of the invention.

Referring more particularly to the drawings, FIG. 1 shows a power supply 22, a coaxial transmission line 24, and a gun barrel 26 mounted on a suitable swivel-type base 28 so that the gun barrel 26 may be readily pointed in the desired direction. In the system of FIG. 1, the gun 26 is not a conventional gun powered by chemical explosives; instead, it is a magnetic gun powered by the magnetic pressure supplied by a powerful electric pulse of short duration supplied by the power supply 22.

The power supply 22 may be of the type known as a homopolar generator. Homopolar generators are described in various publications including an article entitled, "A Multi-Megajoule Inertial Inductive Energy Storage System", by A. E. Robson et al, which appears starting on page 95 of a text entitled, "Energy Storage, Compression, and Switching", edited by W. H. Bostick et al, Plenum Press, 1976.

Figure 2:
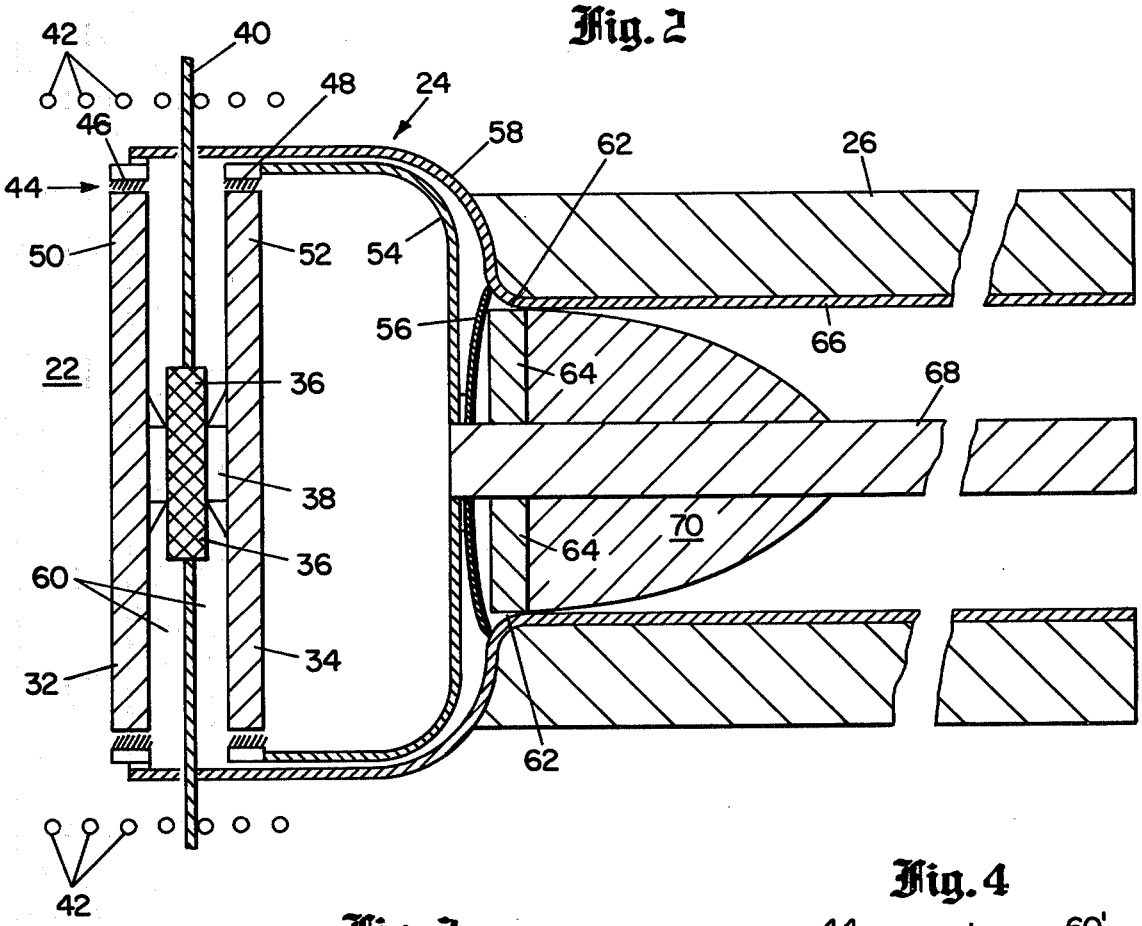
FIG. 2 is a schematic cross-sectional view of the homopolar generator, and additional components of the system of FIG. 1.

FIG. 2 is a schematic cross-sectional showing of the present system, with emphasis on the electrical and switching circuitry aspects. In FIG. 2 the homopolar generator 22 includes two counterrotating rotors 32 and 34 which are driven in opposite directions by a motor 36 which may be powered by hydraulic fluid or by electricity, for example. The rotors 32 and 34 may be of copper or some other mechanically strong electrically conducting material. The rotors act both as energy storing flywheels and as the rotors of a homopolar generator. The bearings 38 permit the rotors 32 and 34 to turn in opposite directions and also permit the coupling of the motor 36 to the rotors, and offer a low resistance electrical coupling between the rotors at their centers. The motor and the bearings may be supported by the flange 40 and additional supports made of insulating material, in accordance with known techniques relative to homopolar generators.

The magnetic coil 42, shown as a series of circles in FIG. 2, supplies a powerful magnetic field parallel to the axis of the unit, and creates a magnetic field in the rotors 32 and 34. The coil 42 may be either conventional or superconducting. The electromotive force (EMF) generated by the homopolar generator 22 is proportional to the product of the rim speed of the rotors, the diameter of the rotors and the magnetic field supplied by the magnet coil. A rim speed of 600 meters per second, rotor diameter of one meter, and magnetic field of 5 Webers/m$^2$ (50 kilogauss) would result in an EMF of 1500 volts between rim 50 and rim 52. The time necessary to bring the rotors up to speed with the magnet coil fully energized to prepare for firing, may be several seconds.

The gun is fired by closing switches 44, i.e., pressing the brushes 46 and 48 against the rotor rims 50 and 52, respectively. The brushes may be of copper coated graphite bristles presently used in high current density applications. The brushes may be momentarily pressed against the rotor rims by a simple externally controlled hydraulic or pneumatic system. Switches 44 may close in about one millisecond. Once switches 44 are closed, the EMF will cause a current to flow from rotor rim 52 through brushes 48, inner electrode 54, low resistance switch 56, outer electrode 58, brushes 46, rotor rim 50, rotor 32, bearings 38, and rotor 34 back to rim 52. The current, which may be several megamperes, flowing in this circuit transfers energy from the flywheels 32 and 34 to a magnetic field which may be concentrated between the rotors. Treated as a lumped circuit element this area containing the magnetic field may be referred to as an inductance 60 which may be of the order of 20 nonohenries. The time to transfer the energy may be of the order of 0.1 sec. The transmission line 24 formed by conductors 54 and 58 may be long and of varied shape so that the homopolar generator 22 and the gun barrel 26 can be relatively independently located and oriented, as indicated in FIG. 1.

The switch 56 may be designed by suitable selection of material and thickness to remain at a low resistance until the current reaches a predetermined level, at which time the resistance of the switch rapidly increases. The attendant rise in voltage across the switch 56 then causes switch 62 to close. Switch 62 could be a simple spark gap. The current then flows through the outer conductor 66 of the gun barrel 26, through the switch 62, the base 64 and the inner conductor 68. The base 64 of conductive material such as copper may either be a sabot that drops away or an integral part of the projectile 70. The magnetic pressure acting on the base 64 causes the base to accelerate down the barrel 26 guided by the walls 66 and the rod 68. By this means the magnetic energy temporarily stored in the inductance 60 is transferred to kinetic energy of the projectile 70 and base 64. The electrodes 54 and 58 and the base 64 may be of copper or some other good conductor. The projectile 70 may be of lead or depleted uranium having a mass of grams or kilograms.

After the projectile 70 and base 64 have left the barrel 26, a high voltage will be created between the base 64 and the electrodes 66 and 68. This voltage may cause the remaining energy in the inductance 60 to dissipate in the air between the base and the barrel. Prior to the base leaving the barrel, the switch 56 must open sufficiently to hold off the EMF so that the current will go to zero and the switches 44 can be opened without drawing an arc which might damage them. Switch 56 may be bimetallic, with a conductive layer of copper engaging conductor 58 being in the order of one millimeter thick.

The gun is reloaded by replacing the projectile 70, base 64, and the switch 56, if it has been damaged.

Figure 3:
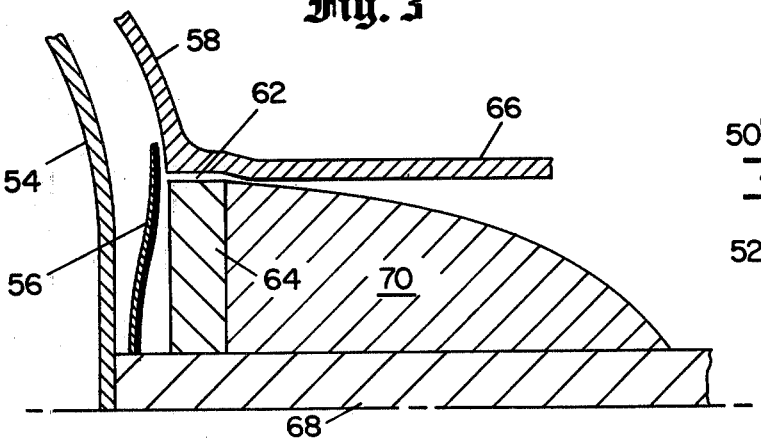
FIG. 3 is a diagrammatic cross-sectional view of one portion of FIG. 2.

FIG. 3 is an enlarged showing of the switches 56 and 62 with both 56 and 62 in the open position. Switch 62 can be made by slightly flaring the outer electrode 66.

Figure 4:
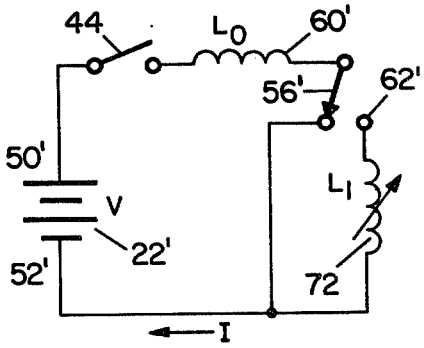
FIG. 4 is a schematic equivalent circuit diagram of the system of FIGS. 1 or 2.

The behavior of the gun may be understood by reference to the simplified equivalent circuit diagram of FIG. 4 in which the homopolar generator voltage (V) appears between rotor rims 50' and 52', the initial inductance 60' is $L_o$, and the variable inductance 72 is the inductance ($L_1$) of the barrel 26 terminated by the base 64. If the diameters of the conductors 68 and 66 are "a" and "b", respectively, and the base 64 is z centimeters down the barrel at time (t), then the inductance ($L_1$) is given by $$L_1 = 2z \ln b/a \text{ nanohenries.} \quad (1)$$

If switch 56 opens and switch 62 closes at time t=0 when the current is $I_o$, then the energy stored in the inductance 60 is $\frac{1}{2} L_o I_o^2$. If the projectile leaves the barrel in a time short compared to $L_o I_o/2V$ then, during this time we can neglect the voltage (V) to get the conditions $LI = L_o I_o$ from the conservation of magnetic flux. Using M as the combined mass of the base 64 and projectile 70, energy conservation yields the following expression:

$$\tfrac{1}{2} M \dot{z}^2 + \tfrac{1}{2} LI^2 = \tfrac{1}{2} L_o I_o^2 \quad (2)$$

The foregoing equations can be solved to give the kinetic energy as follows:

$$\tfrac{1}{2} M \dot{z}^2 = \tfrac{1}{2} L_o I_o^2 \left(1 - \frac{L_o}{L}\right) \quad (3)$$

If $L_o$ is 20 nH, then 90% of the stored energy will be converted to kinetic energy when z is 90 centimeters. If $I_o$ is 10 megamperes, the stored energy is one megajoule.

A one-half kilogram projectile (assuming the base is part of the projectile) can, therefore, reach a speed of 1.9 kilometers per second after traversing 90 centimeters of barrel. These figures do not take frictional or other losses into account. If desired, the homopolar generator may be made with somewhat greater energy output to compensate for such losses.

Figure 5:
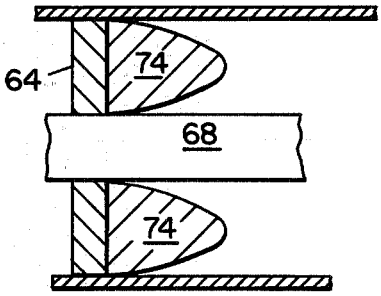
FIG. 5 shows an embodiment of the invention in which several projectiles are fired simultaneously.
Figure 6:
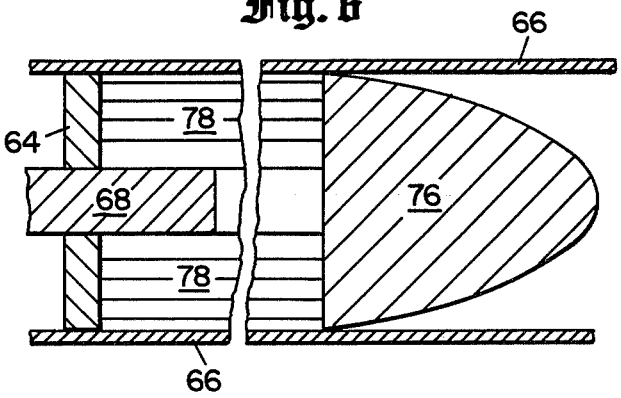
FIGS. 6 and 7 show two alternatives in which a solid, unapertured, projectile is employed.
Figure 7:
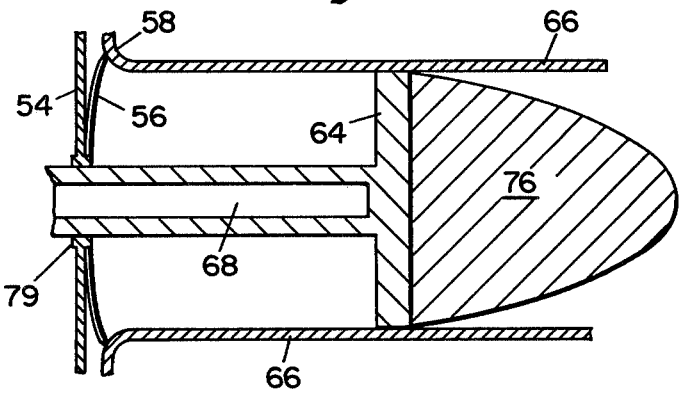

The conducting element 64 may be either a sabot (not an integral part of the projectile) or part of the projectile. In FIG. 2 the projectile 70 is shown to be hollow. Three alternatives to this sabot-projectile configuration are shown in FIGS. 5, 6, and 7. Each of these alternatives permits the projectile to be solid. In FIG. 5 the sabot 64 propels one or more projectiles 74 which are positioned around the center conductor 68. In FIG. 6 the sabot 64 propels the projectile 76 through an intermediate coupling 78 which requires compressional strength in the axial direction. A lightweight honeycomb material may be employed to implement coupling 78. In the arrangement of FIG. 6 the barrel must be twice as long as for the other alternatives. FIG. 7 shows the conducting element 64 fixed to the central conductor 68 is free to move through the electrical contact 79. In this arrangement the magnetic pressure on the conductor 64 causes the conductor 64, the projectile 76 and the center conductor 68 to be propelled down the gun barrel. If desired, the center conductor 68 may be hollow to reduce its mass.

Figure 8:
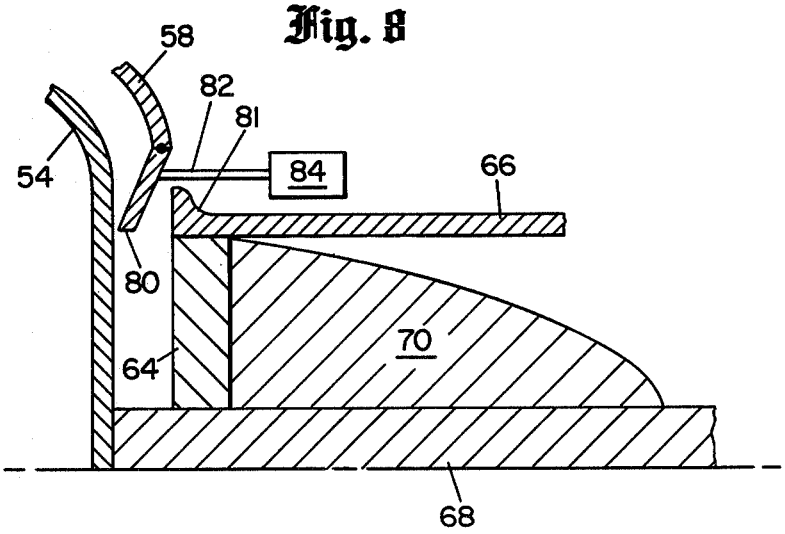
FIG. 8 shows a toggle switch arrangement.

The switches of FIGS. 2 and 3 include one opening switch 56 and one closing switch 62. Four alternatives to the switches of FIGS. 2 and 3 are shown in FIGS. 8, 9, 10 and 11. In FIG. 8 the opening switch includes a movable conductor 80 which is initially in contact with conductor 54. The closing switch consists of this same conductor 80 which is made to come in contact with electrode 81 by mechanical linkage 82 operated by hydraulic actuator 84.

Figure 9:
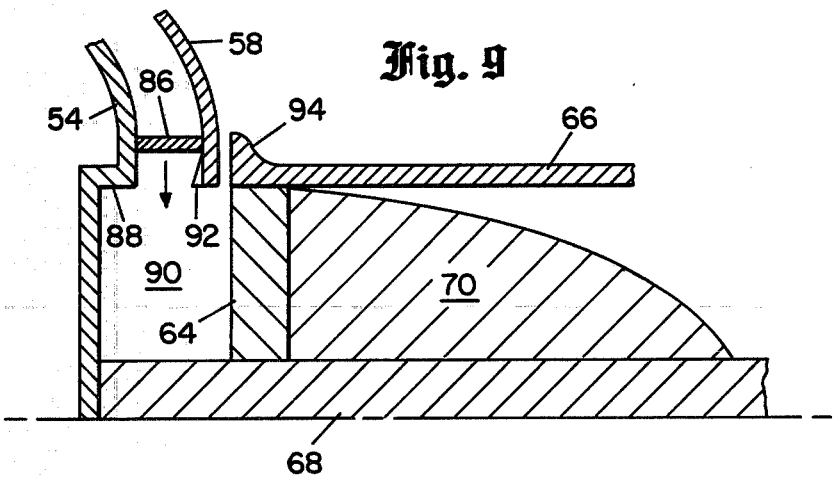
FIG. 9 shows a switching arrangement in which magnetic pressure is employed to actuate the switch.

In FIG. 9, a series of solid movable conductors 86 short circuit the conductors 54 and 58. The magnetic field pressure located between the conductors 54 and 58 acts on the current carried by the conductors 86 to force the conductors 86 to move toward the center conductor 68. The opening switch 56' (FIG. 4) includes the conductors 86 breaking contact with the conductor 54 at the edge 88 as the conductor 86 moves into region 90. The closing switch 62' (FIG. 4) includes the moving conductor 92 which is deflected outward by the passage of conductor 86 to make contact with electrode 94.

Figure 10:
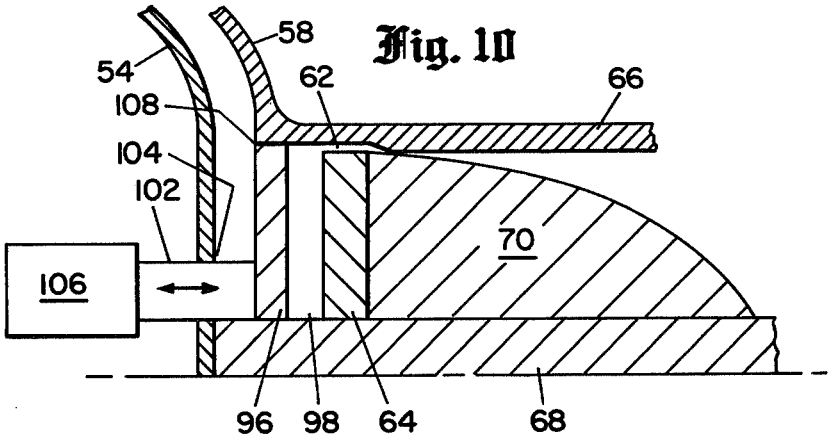
FIG. 10 shows a mechanical switching embodiment.

In FIG. 10 the opening switch involves the moving conductor 96 which is electrically isolated from the conductor 64 by an insulator 98 such as air. The conductor 96 is pulled by mechanical linkages 102 which extend through holes 104 to the actuator 106. The conductor 96 is initially in contact with electrode 66 and the switch is opened when conductor 96 is moved beyond the edge 108. The closing switch is the same as that shown in FIG. 3, viz. a gap 62.

Figure 11:
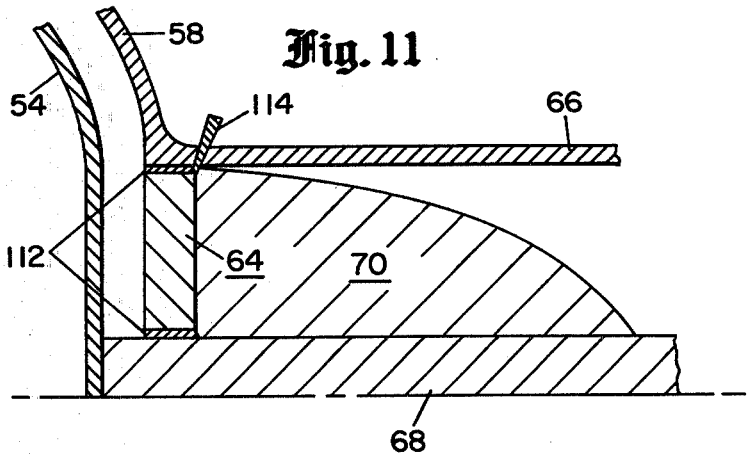
FIG. 11 shows a mechanical detent for restraining initial movement of the projectile.

In FIG. 11 the conductor 64 is held in place by bonding material 112. This bonding material 112, which may be a low temperature melting metal, releases the conductor 64 when the current through conductor 64 reaches the required value. Another option shown in FIG. 11 is to constrain the conductor 64 by pins 114 which break, deflect, or are pulled out through conductor 66 when the desired current threshold has been reached. This option is equivalent to the opening switch 56' (FIG. 4) being permanently open and the closing switch 62' (FIG. 4) being initially closed.

One last set of alternatives takes advantage of the finite skin depth of conductors. If the current risetime in the opening switch 56' were $10^{-4}$ second, the electromagnetic fields and the current could penetrate only 0.16 cm. into copper in this time. Therefore, the conductor 64 could start out in contact with both electrodes 66 and 68 and very little current flows through it until the skin depth exceeds the thickness of the conductor comprising switch 56 (FIG. 3). The changing skin depth acts as the closing switch 62.

Figure 12:
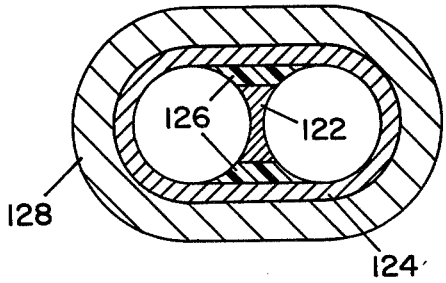
FIG. 12 is a cross-sectional view of a double barrelled magnetic gun alternative.

FIG. 12 shows another alternative arrangement similar to that of FIG. 5. More specifically, FIG. 12 shows a modified coaxial structure with an inner conductor 122 and an outer conductor 124, separated by insulators 126. The outer and inner conductors 58 and 54 from the homopolar generator are connected to conductors 124 and 122, respectively, through suitable transition structures. A pair of projectiles each provided with its own movable conductor similar to conductor 64 of FIGS. 2 and 3 would also be provided. Appropriate switches would also be provided preferably with a single switching arrangement energizing both barrels of the gun. An outer jacket 128 of steel or other high strength material, corresponding to the outer steel jacket 26 shown in FIG. 2, encloses the outer conductor 124. The arrangement of FIG. 12 has the advantage of permitting the use of projectiles of more conventional configuration, without apertures, but the disadvantage of some leakage of the magnetic pressure through the insulator 126.

For completeness, reference is made to our copending U.S. patent application Ser. No. 818,349, filed July 25, 1977, and entitled "High Power Switching System".

In the foregoing description, several illustrative embodiments of the invention have been disclosed. It is to be understood that other mechanical and design variations are within the scope of the present invention. Thus, by way of example and not of limitation, other mechanical and electrical switching arrangements could be used, and known weaponry techniques and arrangements may be utilized. Accordingly, the invention is not limited to the particular arrangements which are illustrated and described in detail.

What is claimed is:

1. A system for accelerating projectiles comprising:
a homopolar generator;
a gun barrel, said gun barrel including two longitudinally extending conductive paths, said longitudinally extending conductive paths comprising coaxial conductors, with the outer coaxial conductor forming a portion of the gun barrel;
annular projectile means being at least initially solid, and having outer cross-sectional dimensions substantially corresponding to the inner cross-sectional dimensions of said gun barrel;
movable highly conductive means in engagement with said projectile means, and extending across between said conductors within said gun barrel near a first end thereof; and
switching means for applying power from said homopolar generator to said conductive paths of said gun barrel at said first end of said gun barrel, whereby said movable conductive means and said projectile are rapidly accelerated down said gun barrel.

2. A system as defined in claim 1 wherein said switching means is located immediately adjacent said first end of said gun barrel.

3. A system as defined in claim 3 wherein said switching means includes bi-metallic means for mechanically breaking electrical contact when heated.

4. A system as defined in claim 1 further comprising means for preventing movement of said movable conductive means until the current from said homopolar generator has built up to a predetermined level.

5. A system as defined in claim 1, including means for converting more than one-half of the energy stored in said homopolar generator into kinetic energy of said projectile means.

6. A system as defined in claim 1, wherein said projectile means has greater longitudinal extent and greater mass adjacent the inner coaxial conductor than adjacent the outer conductor.

7. A system for accelerating projectiles comprising:
power supply means for supplying at least a half a megajoule of electrical power within a fraction of a second;
a gun barrel, said gun barrel including two longitudinally extending conductive paths, said longitudinally extending conductive paths comprising coaxial conductors, with the outer coaxial conductor forming a portion of the gun barrel;
annular projectile means being at least initially solid, and;
means for mounting said projectile means between said conductor within said gun barrel;
movable highly conductive means in engagement with said projectile means and extending across between said conductors within said gun barrel near a first end thereof; and
switching means for applying power from said power supply means to said conductive paths of said gun barrel at said first end of said gun barrel, whereby said movable conductive means and said projectile are rapidly accelerated down said gun barrel.

8. A system as defined in claim 7 wherein at least one switch included in said switching means is located immediately adjacent said first end of said gun barrel.

9. A system as defined in claim 7 further comprising means for preventing movement of said movable conductive means until the current from said power supply means has built up to a predetermined level.

10. A system as defined in claim 7 wherein said power supply means is a homopolar generator.

11. A system as defined in claim 7 wherein said movable conductive means extends substantially across the cross sectional area of said gun barrel from one of said conductors to the other.

12. A system as defined in claim 7 further comprising mechanical means for preventing movement of said movable conductive means and said projectile means until the current from said power supply means builds up to a predetermined level.

13. A system as defined in claim 12 wherein said mechanical means includes yieldable detent means.

14. A system as defined in claim 12 wherein said mechanical means includes meltable material.

15. A system as defined in claim 7 wherein said gun barrel includes an outer jacket of steel enclosing said longitudinally extending conductors.

16. A system as defined in claim 7, including means for converting more than one-half of the energy stored in said homopolar generator into kinetic energy of said projectile means.

17. A system as defined in claim 7, wherein said projectile means has greater longitudinal extent and greater mass adjacent the inner coaxial conductor than adjacent the outer conductor.

18. A system for accelerating projectile comprising:
a homopolar generator;
a gun barrel, said gun barrel including two concentric longitudinally extending conductive paths, one of said longitudinally extending conductive paths enclosing the other;
annular projectile means being at least initially solid, and having outer cross-sectional dimensions substantially corresponding to the inner cross-sectional dimensions of said gun barrel;
movable highly conductive means in engagement with said projectile means, and extending across between said conductors within said gun barrel near a first end thereof; and
switching means for applying power from said homopolar generator to said conductive paths of said gun barrel at said first end of said gun barrel, whereby said movable conductive means and said projectile are rapidly accelerated down said gun barrel.

19. A system for accelerating projectiles comprising:
power supply means for supplying at least a half a megajoule of electrical power within a fraction of a second;
a gun barrel, said gun barrel including two concentric longitudinally extending conductive paths;
annular projectile means being at least initially solid, and;

means for mounting said projectile means within said gun barrel;

movable highly conductive means in engagement with said projectile means and extending across between said conductors within said gun barrel near a first end thereof; and switching means for applying power from said power supply means to said conductive paths of said gun barrel at said first end of said gun barrel, whereby said movable conductive means and said projectile are rapidly accelerated down said gun barrel; at least one switch included in said switching means located immediately adjacent said first end of said gun barrel, said one switch including thin conductive material initially bridging between said two longitudinally extending conductive paths, whereby its resistance abruptly increases after a predetermined period of time, to effectively intertupt the current.

20. A system for accelerating projectiles comprising:

a gun barrel, said gun barrel including two concentric longitudinally extending conductive paths, one of said longitudinally extending conductive paths enclosing the other to increase efficiency by precluding flux leakage;

annular projectile means being at least initially solid, and having outer cross-sectional dimensions substantially corresponding to the inner cross-sectional dimensions of said gun barrel;

movable high conductivity means in engagement with said projectile means, and extending across between said conductors within said gun barrel near a first end thereof;

power supply means for accelerating said projectile means to a velocity in excess of 1.5 kilometers per second in the course of traversing the length of said gun barrel, said power supply means including means for supplying at least a half a megajoule of electrical power to said conductive paths in said gun barrel within a fraction of a second;

switching means for applying power from said power supply means to said conductive paths of said gun barrel at said first end of said gun barrel, whereby said movable conductive means and said projectile are rapidly accelerated down said gun barrel; and said gun barrel including means for providing sufficient mechanical strength to withstand the mechanical forces arising as said projectile is ejected at high velocity.

21. A system for accelerating projectiles comprising:

a gun barrel, said gun barrel including two longitudinally extending conductive paths, said longitudinally extending conductive paths comprising coaxial conductors, with the outer coaxial conductor forming a portion of the gun barrel;

annular projectile means being at least initially solid, and having outer cross-sectional dimensions substantially corresponding to the inner cross-sectional dimensions of said gun barrel; whereby flux leakage is substantially precluded;

movable highly conductive means in engagement with said projectile means, and extending across between said conductors within said gun barrel near a first end thereof;

power supply means for accelerating said projectile means to a velocity in excess of 1.5 kilometers per second prior to exiting from said gun barrel, said power supply means including means for supplying at least one half a megajoule of power to said coaxial conductors; and switching means for applying power from said power supply means to said conductive paths of said gun barrel at said first end of said gun barrel, whereby said movable conductive means and said projectile are rapidly accelerated down said gun barrel, said switching means including movable conductive material being located at the inner end of said gun barrel, and being substantially symmetrically located relative to the axis of said coaxial conductors.

22. A system as defined in claim 21 wherein said switching means includes a movable generally circular conductive member.

23. A system as defined in claim 21 wherein said switching means includes movable conductive material extending radially in at least two opposite directions from the axis of said gun barrel.

* * * * *